US006469240B2

(12) United States Patent
Pachet et al.

(10) Patent No.: US 6,469,240 B2
(45) Date of Patent: Oct. 22, 2002

(54) RHYTHM FEATURE EXTRACTOR

(75) Inventors: François Pachet; Olivier Delerue, both of Paris (FR)

(73) Assignee: Sony France, S.A., Paris (FR)

( * ) Notice: Subject to any disclaimer, the term of this patent is extended or adjusted under 35 U.S.C. 154(b) by 0 days.

(21) Appl. No.: 09/827,550

(22) Filed: Apr. 5, 2001

(65) Prior Publication Data

US 2002/0005110 A1 Jan. 17, 2002

(30) Foreign Application Priority Data

Apr. 6, 2000 (EP) ..... 00 400 948

(51) Int. Cl.[7] ..... G10H 7/00

(52) U.S. Cl. ..... 84/635; 84/603; 84/611; 84/651; 84/667

(58) Field of Search ..... 84/600–604, 609–612, 84/615–616, 622–625, 634–636, 649–652, 653–654, 659–660, 666–668

(56) References Cited

U.S. PATENT DOCUMENTS

| | | | | |
|---|---|---|---|---|
| 4,674,384 A | | 6/1987 | Sakurai | |
| 5,256,832 A | | 10/1993 | Miyake | |
| 5,369,217 A | | 11/1994 | Yamashita et al. | |
| 5,451,709 A | * | 9/1995 | Minamitaka | 84/609 |
| 6,294,720 B1 | * | 9/2001 | Aoki | 84/611 |
| 6,316,712 B1 | * | 11/2001 | Laroche | 84/636 |
| 6,326,538 B1 | * | 12/2001 | Kay | 84/635 |

FOREIGN PATENT DOCUMENTS

| | | |
|---|---|---|
| WO | WO 93 24923 | 12/1993 |

* cited by examiner

*Primary Examiner*—Marlon T. Fletcher
(74) *Attorney, Agent, or Firm*—Frommer Lawrence & Haug LLP; William S. Frommer; Samuel H. Megerditchian

(57) ABSTRACT

The invention relates to a method of extracting a representation of its rhythmic structure, from a given signal. The representation is designed to yield a similarity relation between item titles. There is thus provided a method of extracting the numeric representation of a rhythmic structure for a given item of audio signal, from a database including percussive sounds in an audio signal, comprising the steps of: a) defining said rhythmic structure as a superposition of time series, each of said time series representing a temporal contribution for one of said percussive sounds in an audio signal; b) processing said input signal through a spectral analysis technique, so as to select said rhythmic information contained in said input signal; c) constructing said numeric representation of a rhythmic structure of said input signal by combining a plurality of initial time series; and d) reducing said rhythmic information contained in said plurality of time series by analyzing correlations products thereof, thereby extracting a reduced rhythmic information for an item of audio signal. The method may be combined with the step of e) effecting a distance measure between the items of audio signal on the basis of said reduced rhythmic information, whereby an item of audio signal having similar rhythm is selected.

33 Claims, 5 Drawing Sheets

RHYTHM FEATURE EXTRACTOR

CROSS REFERENCE TO RELATED APPLICATIONS

This application claims the benefit of priority to European Application No. 00 400 948.6, filed on Apr. 6, 2000.

BACKGROUND OF THE INVENTION

The present invention relates to a method that allows to extract, from a given signal, e.g. musical signal, a representation of its rhythmic structure. The invention concerns in particular a method of synthesizing sounds while performing signal analysis. In the present invention, the representation is designed so as to yield a similarity relation between item titles, e.g. music titles. Different music signals with "similar" rhythms will thus have "similar" representations. The invention finds application in the field of "Electronic Music Distribution" (EMD), in which similarity-based searching is typically effected on music catalogues. The latter are accessible via a search code, for instance, "find titles with similar rhythm".

Musical feature extraction has traditionally been considered for short musical signals (e.g. extraction of pitch, fundamental frequency, spectral characteristics). For long musical signals, such as the one considered in the present invention (typically excerpts of popular music titles), some attempts have been made to extract beats or tempo.

Reference can be made to an article on "beat and tempo induction" obtainable through the internet at: http://steplianus2.socsci.kun.nl/mmm/papers/foot-tapping-bib.html There further exists an article concerning a working tempo induction system having the reference:Scheirer, Eric D., "Tempo and Beat Analysis of Acoustic Musical Signals", J. Acoust. Soc. Am., 103(1), pp 588–601, January 1998.

Finally, there exists a PCT patent application entitled "Multifeature Speech/Music Discrimination System", having the filing number WO 9827543A2 with Scheirer, Eric D. and Slaney Malcolm as cited inventors. Further information on this topic can be found through the internet at: (Extract of web page: http://sound.media.mit.edu/~eds/papers.html).

According to the system disclosed in the aforementioned PCT patent application, a speech/music discriminator employs data from multiple features of an audio signal as input to a classifier. Some of the feature data determined from individual frames of the audio signal, and other input data is based upon variations of a feature over several frames, to distinguish the changes in voiced and unvoiced components of speech from the more constant characteristics of music. Several different types of classifiers for labelling test points on the basis of the feature data are disclosed. A preferred set of classifiers is based upon variations of a nearest-neighbour approach, including a K-d tree spatial partitioning technique.

However, higher level musical features have not yet been extracted using fully automatic approaches. Furthermore, the rhythmic structure of a title is difficult to define precisely independently of other musical dimensions such as timbre.

A technical area relating to the above field includes the Mpeg 7 audio community, which is currently drafting a report on "audio descriptors" to be included in the future Mpeg 7 standard. However, this draft is not accessible to the public at the filing date of the application. Mpeg7 concentrates on "low level descriptors", some of which may be considered in the context of the present invention (e.g. spectral centroid).

There exists an article on Mpeg 7 audio available through the internet at: http://www.iua.upf.es/~xserra/articles/cbmi99/cbmi99.html.

From the foregoing, it appears that there is a need for a method for automatically extracting an indication of the rhythmic structure, e.g. of a musical composition, reliably and efficiently.

SUMMARY OF THE INVENTION

To this end, the present invention proposes a method of extracting a rhythmic structure from a database including sounds, comprising at least the steps of a) processing an input signal through an analysis technique, so as to select a rhythmic information contained in said input signal; and b) synthesizing said sound while performing said analysis technique.

The above database may include percussive sounds.

Further, the processing step may comprise processing the input signal through a spectral analysis technique.

Typically, the step of sound synthesis comprises the steps of:

a) synthesizing a new percussive sound from time series of onset peaks and the input signal, and defining the new percussive sound, thereby enabling repeated iterative treatments;

b) performing the iterative treatments until the peak series cycle computed becomes the same as the preceding cycle; and c) selecting two different time series after the input signal has been compared to all percussive sounds for peak extraction.

The method of the invention may also comprise the step of defining said rhythmic structure as time series, each of the time series representing a temporal contribution for one of percussive sounds. Suitably, this defining step is performed prior to the processing step described above.

The above method may further comprise the steps of:

a) constructing the rhythmic structure of the input signal by combining a plurality of onset time series; and b) reducing the rhythmic information contained in the plurality of time series, thereby extracting a reduced rhythmic information for an item. Suitably, the above rhythmic-structure constructing and rhythmic-information reducing steps are carried out subsequently to the sound-synthesizing step described above.

In the above method, the rhythmic structure may be given by a numeric representation for a given item of audio signal, and the percussive sounds in said database are given in an audio signal.

Preferably, the above defining step comprises defining the rhythmic structure as a superposition of time series, each of the time series representing a temporal contribution for one of the percussive sounds in an audio signal.

Suitably, the above constructing step comprises constructing the numeric representation of a rhythmic structure of the input signal by combining a plurality of onset time series.

Suitably yet, the above reducing step comprises reducing the rhythmic information contained in the plurality of time series by analyzing correlations products thereof, thereby extracting a reduced rhythmic information for an item of audio signal.

There is also provided a method of determining a similarity relation between items of audio signals by comparing their rhythmic structures, one of the items serving as a reference for comparison, comprising the steps of determining a rhythmic structure for each item of audio signal to be compared by carrying out the above-mentioned steps, and effecting a distance measure between the items of audio signal on the basis of a reduced rhythmic information, whereby an item of audio signal within a specified distance of a reference item in terms of a specified criteria is considered to have a similar rhythm.

The above method may further comprise the step of selecting an item of audio signal on the basis of its similarity to the reference audio signal.

Further, the defining step may comprise defining each of time series as representing a temporal peak of a given percussive sounds.

Further yet, the processing step may comprise the step of peak extraction effected on the input signal.

The step of peak extraction may comprise extracting the peaks by analyzing a signal as harmonic sound and a noise.

The above-mentioned processing step may comprise the step of peak filtering.

Preferably, the step of peak filtering comprises extracting the onset time series representing occurrences of the percussive sounds in the audio signal, repeatedly until a given threshold is reached.

The step of peak filtering may further comprise comparing the audio signals to each of the percussive sounds contained in the database via a correlations analysis technique which computes a correlation function values for an audio signal and a percussive sound.

Furthermore, the step of peak filtering may comprise assessing the quality of the peak of the time series resulted, by filtering out the correlation function values under a given amplitude threshold, filtering out the peaks having an occurrence time under a given time threshold, and filtering out the peaks missing a given quality threshold, thereby producing onset time series having a peak position vector and a peak value vector.

In the inventive method, the above-mentioned processing step may comprise the step of correlations analysis.

Further, the step of correlations analysis may comprise the steps of formulating correlations products of time series, selecting a tempo value from the correlations products and scaling the tempo value.

In this method, the formulating step may comprise the steps of:

a) specifying, as input, two time series representing onset time series of two main percussive sounds in the signal;

b) providing, as an output, a set of numbers representing a reduction of the rhythmic information contained in the input series; and c) computing the correlations products of the two time series.

Typically, the selecting step comprises selecting the tempo value representing a prominent period in the signal.

Further, the selecting step may comprise extracting a tempo value from the correlations products, whereby the prominent period is selected within a given range.

In the above inventive method, the scaling step may comprise the steps of:

a) scaling the time series according to the tempo value and the value in amplitude, thereby yielding a new set of normalized time series; and b) trimming and/or reducing the correlations products, thereby retaining the values for each of the normalized correlation products contained in a given range.

Likewise, the scaling step may comprise scaling the time series through the correlations products.

Preferably, the step of effecting a distance measure comprises computing the two items of audio signal on the basis of an internal representation of the rhythm for each item of audio signal, thereby reducing the data computed from the correlations products to simple numbers.

The above step of effecting a distance measure may also comprise constructing the internal representation of the rhythm as follows:

a) computing a representation of the morphology for each of the time series as a set of coefficients respectively representing the contribution in the time series of a filter; and b) applying each filter to a time series, thereby yielding given numbers for representing the rhythm.

Furthermore, the step of effecting a distance measure may comprise representing each signal by the given numbers representing the rhythm, and performing said distance measure between two signals.

In the method described above, the item of audio signal may comprise a music title, and the audio signal may comprise a musical audio signal.

Further, the percussive sounds contained in the database may comprise audio signals produced by percussive instruments, Further yet, the two input series may respectively represent a bass drum sound and a snare sound.

According to the present invention, there is also provided a system programmed to implement the method described above, comprising a general-purpose computer and peripheral apparatuses thereof.

There is further provided a computer program product loadable into the internal memory unit of a general-purpose computer, comprising a software code unit for carrying out the steps of the inventive method described above, when said computer program product is run on a computer.

BRIEF DESCRIPTION OF THE DRAWINGS

The above and the other objects, features and advantages will be made apparent from the following description of the preferred embodiments, given as non-limiting examples, with reference to the drawings, in which.

DETAILED DESCRIPTION OF THE PREFERRED EMBODIMENTS

The idea of synthesizing the sounds while analyzing the signals has an advantage that it allows to detect the occurrences of sounds which are not apparent or known a priority.

Figure 3:
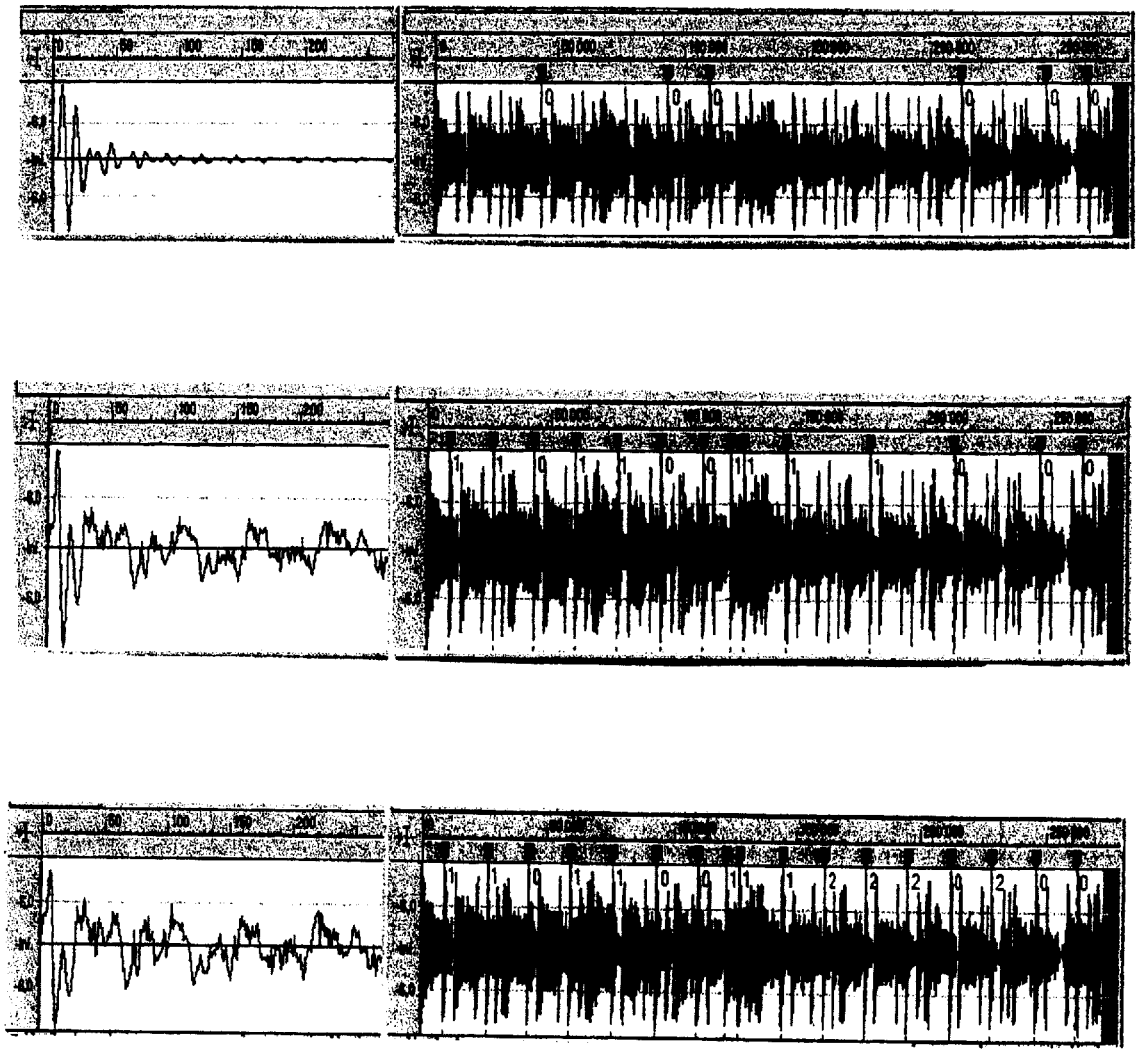
FIG. 3 shows spectra illustrating the results obtained by applying the method of progressively detecting and extracting the occurrences of a percussive sound in an input signal according to an embodiment of the invention.

In FIG. 3, the left hand side spectra show three successive sounds, in which the top spectrum represents a general sound, and the other two spectra represent sounds synthesized from the input signal, respectively. The right hand side spectra show the peaks detected from the corresponding percussive sound in the input signal.

Figure 4:
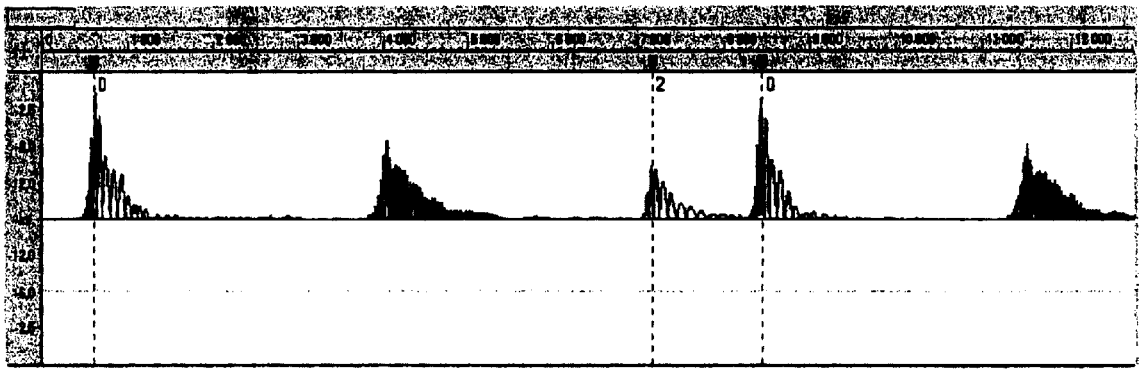
FIG. 4 is a spectrum illustrating the peaks obtained by a quality measure of peaks according to an embodiment of the invention.

As shown in FIG. 4, the quality measure of peaks described above allows to detect only the peaks actually corresponding to the real occurrences of a given percussive sound, even when these peaks have less local energy than other peaks corresponding to another percussive sound.

In a preferred implementation, the present invention involves two phases:

1) a training phase, during which some parameters of the invention are tuned, and clusters/categories of related music titles are made, and
2) a working phase, during which the invention yields clusters which are similar to the input title. These phases can typically have the following characteristics:

1) Training Phase:
Input: a database of musical signals in a digital format, e.g. "wav", having a duration typically of 20 seconds or more.
Output: a set of clusters for this database.
2) Working phase:
Input: a musical signal in a digital format, e.g. "wav", having a duration typically of 20 seconds or more.
Output: a distance measure between this title and other titles of the database.
This measure yields a set of clusters containing titles having a similar rhythmic structure with input title.

There is described hereafter the main module of the invention, which consists in extracting, for one given music title, a numeric representation of its rhythmic structure, suited for building automatically clusters (training phase) and finding similar clusters (working phase), using standard classification techniques.

Rhythm Extraction for One Title

The rhythmic structure is defined as a superposition of time series. Each time series represents temporal peaks of a given percussive instrument in the input signal. A peak represents a significant contribution of a percussive sound in the signal. For a given input signal, several time series are extracted (in practice, there will be extracted only two), for different percussive instruments of a library of percussive sounds.

Once these time series are extracted, a data reduction process is performed so as to extract the main characteristics of the time series individually (each time series), and collectively (relation between time series).

This data reduction process yields a multi-dimensional point in a feature space, containing reduced information about the various auto-correlation and correlation parameters of each time series, and each combination of time series.

Figure 1:
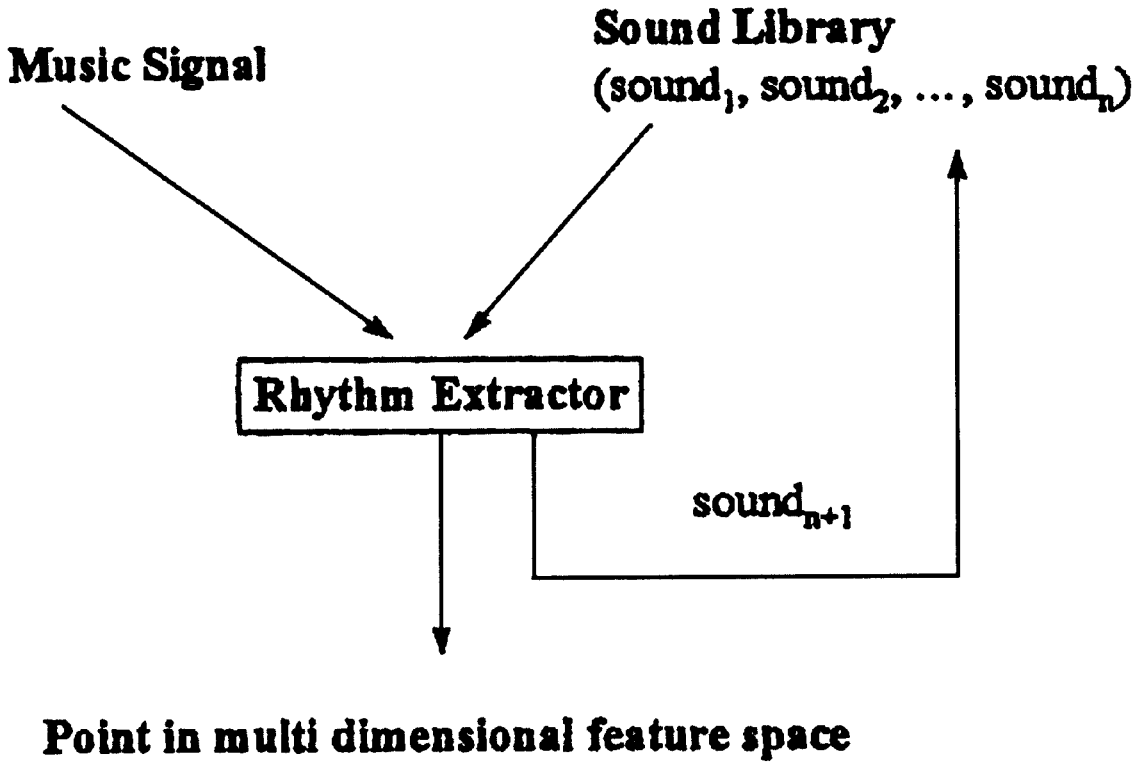
FIG. 1 is a symbolic representation illustrating the general scheme of present invention.

This global scheme is illustrated in FIG. 1.

Figure 5:
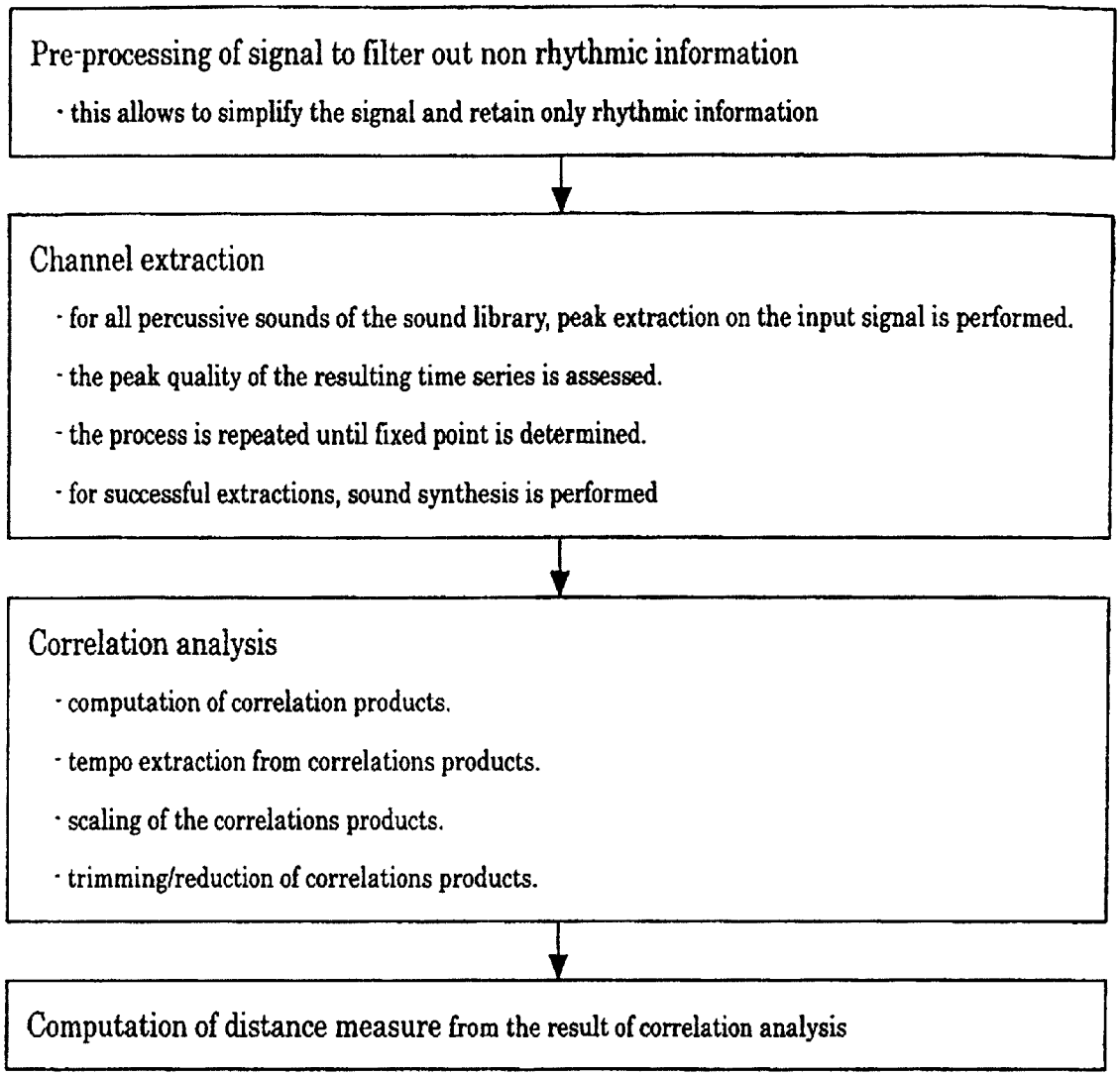
FIG. 5 is a flow chart showing the steps of pre-processing of signal, channel extraction, correlation analysis and computation of distance according to an embodiment of the invention.

The method according to the preferred embodiment of the invention produces at least some of the following actions:

1) it performs a preprocessing of the input signal to suppress the non rhythmic information contained in the signal, using a spectral analysis technique,
2) it builds a representation of the rhythmic structure of the input signal by combining several onset times series representing the occurrences of percussive sounds in the signal.
3) it uses a library of percussive sounds to extract these time series from the signal,
4) it builds up the library of percussive sounds iteratively, using a sound synthesis module.
5) it reduces the information given in the time series by computing auto-correlation and cross-correlation products of the time series,
6) it performs a simple tempo extraction from the analysis of the correlation of the time series,
7) It uses this reduced information to yield a distance measure between two music titles, As seen in FIG. 5, the extraction of the reduced rhythmic information for a music title proceeds in several phases:

pre-processing of the signal to filter out non rhythmic information—this allows to simplify the signal and to retain only rhythmic information.

1) Channel Extraction:
for all percussive sounds of the sound library, peak extraction on the input signal is performed.
the peak quality of the resulting time series is assessed.
the process is repeated until fixed point is determined.
for successful extractions, sound synthesis is performed.
2) Correlation Analysis Involves:
computation of correlation products
tempo extraction from correlation products
scaling of the correlations products
trimming/reduction of correlations products
3) Computation of a Distance Measure From the Result of 2).

Definition of the Four Modules Used in the Preferred Embodiment.

1) Pre-processing of the Signal to Filter Out Non Rhythmic Information.

This aspect makes use of techniques similar to the SMS approach: analysis of a signal as harmonic sound+noise, for instance, using technique similar to that described in "Musical Sound Modelling With Sinusoids Plus Noise", Xavier Serra, published in C. Roads, S. Pope, A. Picialli, G. De Poli, editors. 1997. "Musical Signal Processing", Swets & Zeitlinger Publishers.

2) Channel Extraction

Figure 2:
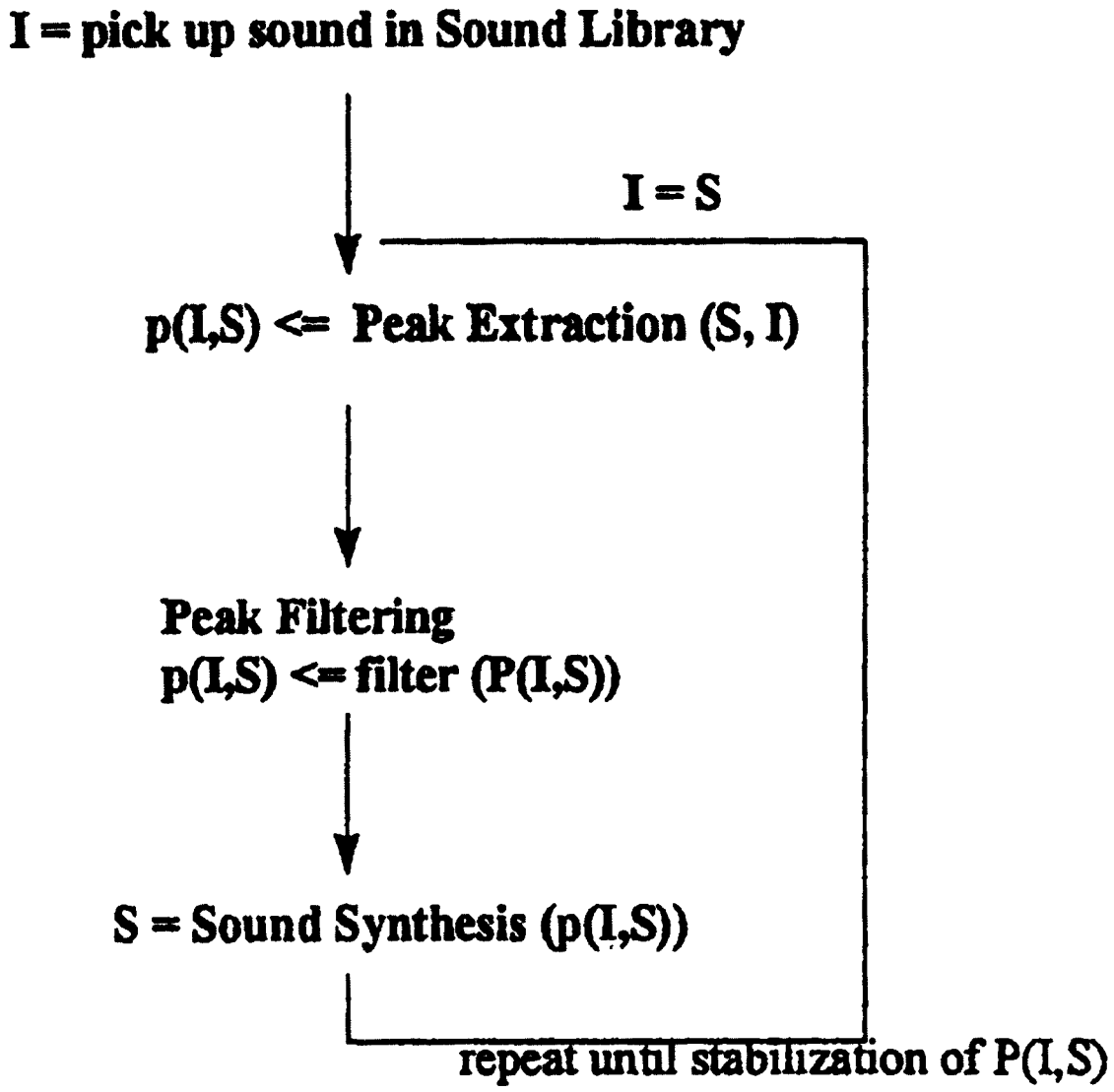
FIG. 2 is a diagram showing the steps of peak extraction, assessment and sound synthesis in accordance with the present invention.

This module extracts the onset time series representing occurrences of percussive sounds in the signal. The general scheme for extraction is represented in FIG. 2. It consists in applying an extraction process repeatedly until a fixed point is reached.

i) Comparing the signal to each sound of the percussive sound library using a correlation technique.
This technique computes the correlation function Cor ($\partial$) for a signal S(t), t belongs to [1, $N_S$] and an instrument sound I(t), with t belongs to [1, $N_I$]:

$$Cor(\partial) = \sum_{t=\partial+1}^{N_I+\partial} S(t) \times I(t-\partial) \text{ which is defined for}$$

$$\partial \in [0, N_s - N_I - 1]$$

ii) Computing and assessing the peak quality of the resulting time series.

This module is performed by applying a series of filters as follows:

a) Filtering out all the values of the Cor function which are under an "amplitude threshold" TA, defined as: TA=$^{50}/_{100}$*Max(Cor).
b) Filtering out all the peaks which lie "too close", i.e. whose occurrence time is less than a time threshold TS away from another peak. TS is set to represent typically 10 milliseconds of the signal.
c) Filtering out all peaks which do not have a sufficiently high "quality" measure. This quality measure is computed as the ratio of the local energy at peak t in the correlation signal Cor, by the local energy around $$t: Q(Cor, t) = \frac{Cor(t)^2}{\frac{1}{picWidth}\sum_{i=t-\frac{picWidth}{2}}^{t+\frac{picWidth}{2}} Cor(i)^2}$$

with typically: picWidth=500 samples which correspond to a duration 45 milliseconds at a 11025 Hz sample rate.

Only those peaks for which Q(p)>TQ, where TQ is a quality threshold, set to $^{50}/_{100}$*Max(Q(cor, t)).

The resulting onset time series is represented by 2 vectors: peakPosition(i), and peakValue(i), where 1<=i<=nbPeaks d) At this point, a new percussive sound is synthesized, from the time series of peaks, and the original signal. This new synthesized sound is defined as:

$$newInst(t) = \frac{1}{nbPeaks}\sum_{i=1}^{nbPeaks} S(peakPosition(i) + t)$$

where $t$ belongs to $[1, N_i]$, e) The process is repeated by replacing the instrument I by newInst.

This iteration is performed until the peak series computed is the same as computed in the preceding cycle (fixed point iteration).

Once the signal has been compared to all percussive sounds for peak extraction, two time series are chosen according to the following criteria:

The two time series should be different, and not subsume one another.

In case of conflict (i.e. two tine series candidate, with different sounds), choose the time series with the maximum number of peaks Eventually, there are obtained two time series, that are sort out according to the spectral centroid of the matching percussive instrument. (the first time series represent the "bass drum" sound, and the second the "snare" sound). Even if the percussive sounds do not sound like a bass drum and a snare drum, this sorting is performed only to ensure that time series will be produced and compared in a fixed order.

3) Correlation Analysis

This module takes as input the two time series computed by the preceding module, and representing the onset time series of the two main percussive instruments in the signal. The module outputs a set of numbers representing a reduction of this data, and suitable for later classification.

The series are indicated as $TS_1$and $TS_2$.

The module consists of the following steps:

i) Computation of correlation products:

For each time series, C11, C22 and C12 are computed as the correlation products of TS1 and TS2 as follows:

$$C_{1,1}(\partial) = \sum_i TS_1(t) \times TS_1(t-\delta)$$

$$C_{2,2}(\partial) = \sum_i TS_2(t) \times TS_2(t-\partial)$$

$$C_{1,2}(\partial) = \sum_i TS_1(t) \times TS_2(t-\partial)$$

ii) Tempo extraction from correlation products

A tempo is extracted from the correlation products using the following procedure:

There is computed MAX=MAX($C_{11}$(t)+$C_{22}$(t)), with t>0 (starting at t>0 to avoid considering C11(0), which represents the energy of C11).

The value of the index of MAX (IMAX) represents the most prominent period in the signal, that is assumed as being the tempo, with a possible multiplicative factor.

Only tempo values between [60 bpm, 180 bpm], i.e. periods in [250 ms, 750 ms] are considered. Therefore, if the prominent period is not within this range, it is folded, i.e.:

if (*IMAX*<250 ms)*IMAX=IMAX**2;

if (*IMAX*>250 ms)*IMAX=IMAX*/2;

iii) Scaling of the correlation products

Once the tempo is extracted, the time series are scaled to normalize them according to the tempo and to the max value in amplitude. This yields a new set of three normalized time series:

$CN_{11}(t)=C_{11}(t*IMAX)/MAX;$ $CN_{22}(t)=C_{22}(t*IMAX)/MAX;$ $CN_{12}(t)=C_{12}(t*IMAX)/MAX;$ iv) Trimming/Reduction of correlation products There is retained only the values between 0 and 1 for each normalized correlation series.

4) Computation of a Distance Measure From the Result of Module 3).

The distance measure for two titles is based on an internal representation of the rhythm for each music title, which reduces the data computed in module 3) to simple numbers.

i) Construction of an internal representation of the rhythm.

For each time series $CN_{ij}$, there is computed a representation of its morphology as a set of coefficients representing each the contribution in the time series of a comb filter.

The set of comb filters $F_l$, $F_n$ is designed as follows:

$$F_n(t) = \sum_{i=1, i\ prime\ with\ n}^{n} \text{gauss}\left(t - \frac{i}{n}\right)$$

That is, each comb filter $F_i$ represents a division of the range [0, 1] in fractions ¼, ⅔, (i−1)/i, with the condition that only prime fractions are included, to avoid duplication of a fraction in a preceding filter ($F_j$, j<i).

The function gauss(t) is a Gaussian function with a decaying coefficient sufficiently high to avoid crossovers (e.g. set to 30).

The application of each filter $F_i$ to a time series CN therefore yields N numbers.

The figure is set as N=8 in the context of the present invention, which allows to describe rhythmic patterns having binary, ternary, etc. up to octuary divisions. However, other numbers can be envisaged according to requirements.

The three time series $CN_{ij}$ yield eventually 3*8=24 numbers representing the rhythm.

ii) Representation of the rhythm in a multi-dimensional space and associated distance.

Each musical signal S is eventually represented by 24 numbers using the scheme described above. The distance measure between two signals $S_1$ and $S_2$ is a weighted sum of the squared differences in this space:

$$D(S_1, S_2) = \sum_{i=1}^{24} \alpha_i (S_1(i) - S_2(i))^2$$

The values of the weights $\alpha_i$ are determined by using standard data analysis techniques.

What is claimed is:

1. A method of extracting a rhythmic structure from a database including sounds, comprising the steps of:

a) inputting an input signal;

b) processing an input signal through an analysis technique for selecting a rhythmic information contained in said input signal; and c) synthesizing said sound while performing said analysis technique, said synthesis comprising the steps of:

i) synthesizing a new percussive sound from time series of onset peaks in said input signal, and defining said new percussive sound, for repeated iterative treatments;

ii) performing said iterative treatments until the peak series cycle computed is the same as a preceding cycle; and iii) selecting two different time series after said input signal has been compared to all percussive sounds for peak extraction.

2. The method of claim 1, wherein said database includes percussive sounds.

3. The method of claim 1, wherein said processing step comprises processing said input signal through a spectral analysis technique.

4. The method of claim 1, comprising the step of defining said rhythmic structure as time series, each of said time series representing a temporal contribution for one of percussive sounds.

5. The method of claim 1, comprising the steps of:

a) constructing said rhythmic structure of said input signal by combining a plurality of onset time series; and b) reducing said rhythmic information contained in said plurality of time series, thereby extracting a reduced rhythmic information for an item.

6. The method of claim 5, wherein said rhythmic structure is given by a numeric representation for a given item of audio signal, and said percussive sounds in said database are given in an audio signal.

7. The method of claim 4, wherein said defining step comprises defining said rhythmic structure as a superposition of time series, each of said time series representing a temporal contribution for one of said percussive sounds in an audio signal.

8. The method of claim 5, wherein said constructing step comprises constructing said numeric representation of a rhythmic structure of said input signal by combining a plurality of onset time series.

9. The method of claim 5, wherein said reducing step comprises reducing said rhythmic information contained in said plurality of time series by analyzing correlations products thereof, thereby extracting a reduced rhythmic information for an item of audio signal.

10. Method of determining a similarity relation between items of audio signals by comparing their rhythmic structures, one of said items serving as a reference for comparison, comprising the steps of determining a rhythmic structure for each item of audio signal to be compared by carrying out the steps of claim 1, and effecting a distance measure between said items of audio signal on the basis of a reduced rhythmic information, whereby an item of audio signal within a specified distance of a reference item in terms of a specified criteria is considered to have a similar rhythm.

11. The method of claim 10, further comprising the step of selecting an item of audio signal on the basis of its similarity to said reference audio signal.

12. The method of claim 4, wherein said defining step comprises defining said each of time series as representing a temporal peak of a given percussive sounds.

13. The method of claim 1, wherein said processing step comprises the step of peak extraction effected on said input signal.

14. The method of claim 13, wherein said step of peak extraction comprises extracting said peaks by analyzing a signal as harmonic sound and a noise.

15. The method of claim 1, wherein said processing step comprises the step of peak filtering.

16. The method of claim 15, wherein said step of peak filtering comprises extracting said onset time series representing occurrences of said percussive sounds in said audio signal, repeatedly until a given threshold is reached.

17. The method of claim 15, wherein said step of peak filtering comprises comparing said audio signals to each of said percussive sounds contained in said database via a correlations analysis technique which computes a correlation function values for an audio signal and a percussive sound.

18. The method of claim 15, wherein said step of peak filtering comprises assessing the quality of said peak of said time series resulted, by filtering out the correlation function values under a given amplitude threshold, filtering out the peaks having an occurrence time under a given time threshold, and filtering out the peaks missing a given quality threshold, thereby producing onset time series having a peak position vector and a peak value vector.

19. The method of claim 1, wherein said processing step comprises the step of correlations analysis.

20. The method of claim 19, wherein said step of correlations analysis comprises the steps of formulating correlations products of time series, selecting a tempo value from said correlations products and scaling said tempo value.

21. The method of claim 20, wherein said formulating step comprises the steps of:

a) specifying, as input, two time series representing onset time series of two main percussive sounds in said signal;

b) providing, as an output, a set of numbers representing a reduction of the rhythmic information contained in the input series; and c) computing the correlations products of said two time series.

22. The method of claim 20, wherein said selecting step comprises selecting said tempo value representing a prominent period in said signal.

23. The method of claim 22, wherein said selecting step comprises extracting a tempo value from said correlations products, whereby said prominent period is selected within a given range.

24. The method of claim 21, wherein said scaling step comprises the steps of:

a) scaling said time series according to said tempo value and the value in amplitude, thereby yielding a new set of normalized time series; and b) trimming or reducing correlations products, thereby retaining the values for each of said normalized correlation products contained in a given range.

25. The method of claim 24, wherein said scaling step comprises scaling said time series through said correlations products.

26. The method of claim 10, wherein said step of effecting a distance measure comprises computing said two items of audio signal on the basis of an internal representation of the rhythm for each item of audio signal, thereby reducing the data computed from said correlations products to simple numbers.

27. The method of claim 26, wherein said step of effecting a distance measure comprises constructing said internal representation of the rhythm as follows:

a) computing a representation of the morphology for each of said time series as a set of coefficients respectively representing the contribution in said time series of a filter; and b) applying each filter to a time series, thereby yielding given numbers for representing said rhythm.

28. The method of claim 26, wherein said step of effecting a distance measure comprises representing each signal by said given numbers representing the rhythm, and performing said distance measure between two signals.

29. The method of claim 1, wherein said item of audio signal comprises a music title, and said audio signal comprises a musical audio signal.

30. The method of claim 1, wherein said percussive sounds contained in said database comprise audio signals produced by percussive instruments.

31. The method of claim 21, wherein said two input series respectively represent a bass drum sound and a snare sound.

32. A system programmed to implement the method of claim 1, comprising a general-purpose computer and peripheral apparatuses thereof.

33. A computer program product loadable into the internal memory unit of a general-purpose computer, comprising a software code unit for carrying out the steps of claim 1, when said computer program product is run on a computer.

* * * * *